US006863348B1

(12) United States Patent
Cvek

(10) Patent No.: US 6,863,348 B1
(45) Date of Patent: Mar. 8, 2005

(54) CHAIR BACK ASSEMBLY

(75) Inventor: Sava M. Cvek, Jamaica Plain, MA (US)

(73) Assignee: Stylex, Inc., Delanco, NJ (US)

( * ) Notice: Subject to any disclaimer, the term of this patent is extended or adjusted under 35 U.S.C. 154(b) by 0 days.

(21) Appl. No.: 10/431,182

(22) Filed: May 7, 2003

(51) Int. Cl.[7] ..... A47C 7/42
(52) U.S. Cl. ..... 297/440.2
(58) Field of Search ..... 297/440.1, 440.2, 297/440.21, 452.18, 452.2; 403/333, 334, 373, 374.1, 374.2, 374.3, 381, 409.1

(56) References Cited

U.S. PATENT DOCUMENTS 2,115,258 A * 4/1938 Ferreira et al. ..... 297/447.3
2,186,301 A * 1/1940 La More ..... 297/440.21
2,440,470 A * 4/1948 Meyer ..... 297/440.21
3,556,592 A * 1/1971 Antoine ..... 297/440.2
4,365,840 A * 12/1982 Kehl et al. ..... 297/440.2
4,746,168 A * 5/1988 Bracesco ..... 297/440.2
5,326,155 A * 7/1994 Wild ..... 297/452.38
6,305,747 B1 * 10/2001 Mei ..... 297/440.2

* cited by examiner

*Primary Examiner*—Peter R. Brown
(74) *Attorney, Agent, or Firm*—Stuart E. Beck

(57) ABSTRACT

A chair back assembly where the connectors for connecting the elements comprising the back assembly are hidden from view. The assembly includes a chair back having a lateral edge. First and second elements are connected to each other and to the chair back. One of the first and second elements connected to the remainder of the chair and means are provided for connecting the first and second elements to each other and to the chair back where the means for connecting the first and second elements to each other and to the chair back are hidden from view.

17 Claims, 1 Drawing Sheet

CHAIR BACK ASSEMBLY

FIELD OF THE INVENTION

This invention relates to chairs, and more particularly, to a chair back assembly.

BACKGROUND OF THE INVENTION

Side chairs and armchairs for office waiting rooms, conference rooms, reception areas and the like are widely used in many different industries and environments.

It is important for such chairs to be attractive as well as comfortable. Thus, as between chairs of substantially equal comfort the one that is more attractive will be more likely to be desired by the customer.

A particular way of helping to create an attractive chair with an interesting appearance is by providing a chair where the back is secured by an assembly where the connectors are hidden from view.

Such a construction is not only aesthetically pleasing to view, but also minimizes the likelihood of injury to property and/or person by scratches or snags on exposed connectors.

SUMMARY OF THE INVENTION

Accordingly, with the foregoing in mind, the invention relates to a chair back assembly where the connectors for connecting the elements comprising the back assembly are hidden from view. The assembly includes a chair back having a lateral edge. First and second elements are connected to each other and to the chair back.

One of the first and second elements connected to the remainder of the chair and means are provided for connecting the first and second elements to each other and to the chair back where the means for connecting the first and second elements to each other and to the chair back are hidden from view.

DESCRIPTION OF A PREFERRED FORM OF THE INVENTION

Figure 1:
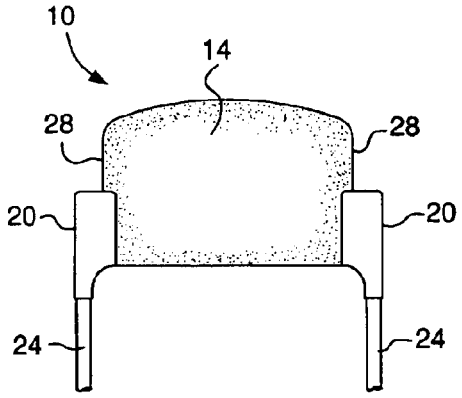
FIG. 1 is a front elevation view of a chair back assembly constructed in accordance with a presently preferred form of the invention.

Referring to the drawing, in FIG. 1 is seen a chair back assembly 10 which is constructed in accordance with a presently preferred form of the invention.

The chair back assembly 10 includes a chair back 14 and brackets 20 on each side of the chair back 14 which are connected to upwardly extending members 24. The upwardly extending members 24 may comprise the rear legs of the chair or part of the structure supporting the seat. These items are not shown as they are well known in the industry and form no part of the present invention.

As best seen in FIG. 1, the chair back 14 includes two lateral edges 28 and 30. The brackets 20 are connected to the lateral edges 28 and 30 as will be more fully explained. As the brackets 20 on each side of the chair back 14 are identical mirror images of each other, only the bracket 20 attached to lateral edge 28 will be described; it being understood that this description will also serve as the description for the bracket 20 attached to lateral edge 30.

In FIGS. 2–6 it can be seen that bracket 20 includes an inwardly facing channel 34 that is fitted over lateral edge 28. The channel comprises legs 38 and 40 which closely fit against the front and back surfaces of the chair back 14 and a web 44 which lies adjacent the lateral edge 28. The web 44 may include a plurality of vertically arranged openings 50 for receiving connectors for connecting the inwardly facing channel 34 to the lateral edge 28 as will be more fully described.

Preferably, the channel 34 is made from a rigid metal or thermoplastic such as nylon. It is best used to support the chair back 14 when it is connected to the rest of the chair back assembly 10. Also, it is used as a spacer so that brackets 20 of one size can be used with chair backs 14 of different thicknesses.

Thus, the provision of a variety of sets of inwardly facing channels 34 where each set of channels 34 have the same external dimensions but different internal dimensions will enable brackets 20 of one size to fit chair backs 14 of different thicknesses. Such a feature dramatically reduces manufacturing costs because the only part of the chair back assembly 10 that needs to be specially sized are the channels 34.

While two vertically arranged openings 50 are shown in web 44, it is apparent that there could be more openings or less openings as desired. However, the provision of at least two openings will reduce any tendency of the chair back 14 rotate relative to the brackets 20.

Referring to FIGS. 2 and 4–6, the bracket 20 includes a first elongated element 60 which overlies inwardly facing channel 34 when the bracket 20 is connected to the lateral edge 28 of the chair back 14.

Figure 4:
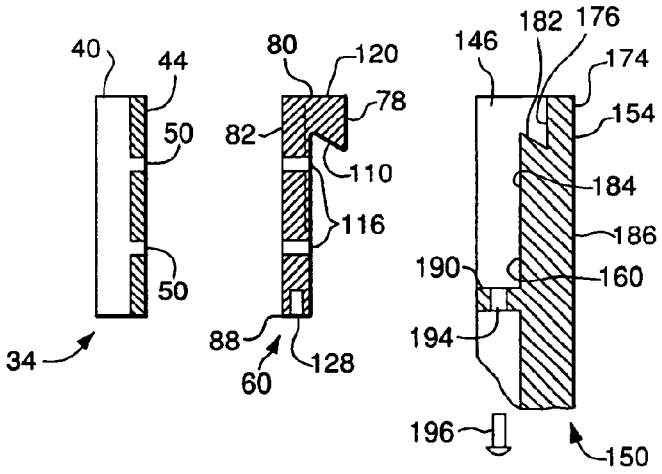
FIG. 4 is an exploded side elevation view of the elements comprising the invention.
Figure 5:
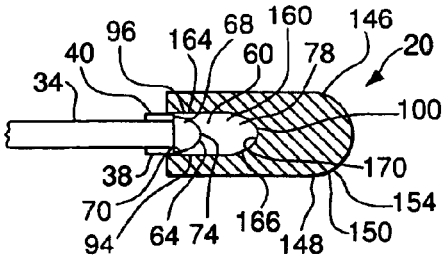
FIG. 5 is a sectional view taken along lines 5—5 of FIG. 2.
Figure 6:
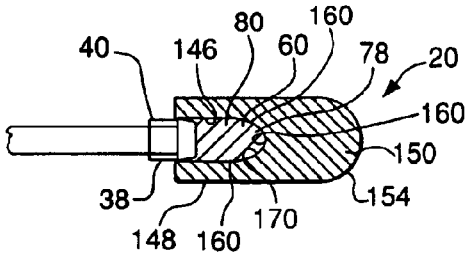
FIG. 6 is a sectional view taken along lines 6—6 of FIG. 2.

Thus, as best seen in FIGS. 4–6, the first element 60 includes an inwardly facing elongated channel shaped recess 64 which is defined by inwardly facing side walls 68 and 70 and an inwardly facing bottom wall 74.

The elongated channel shaped recess 64 closely overlies inwardly facing channel 34 with its inwardly facing side walls side walls 68 and 70 and its inwardly facing bottom wall 74 lying against the outer surfaces of legs 38 and 40 and web 44 of inwardly facing channel 34.

The top portion 78 of the first elongated element 60 includes a laterally outwardly extending head 80.

Figure 2:
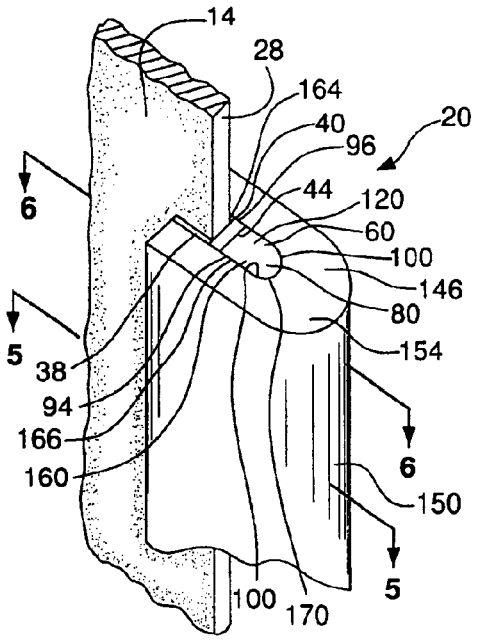
FIG. 2 is a three-quarter view of a chair back assembly constructed in accordance with a presently preferred form of the invention.
Figure 3:
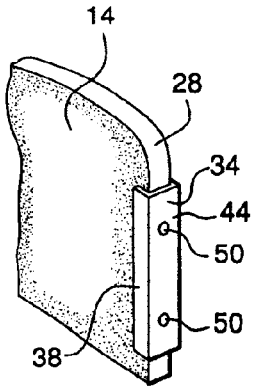
FIG. 3 is a three-quarter view of one of the elements comprising the invention.

Both the laterally extending head 80 and the top portion 78 of the first elongated element 60 are generally "D"-shaped in cross-section as seen in FIGS. 2, 5 and 6 in that its side walls 94 and 96 merge into a curved rear wall 100.

As best seen in FIG. 4, the lower surface of laterally extending head 80 includes a downwardly facing camming surface 110 which is angularly disposed so that it extends upwardly and inwardly toward the lower portion 82 of the first elongated element 60.

The lower portion 82 of the first elongated element 60 includes a plurality of openings 116 which may be vertically arranged so that they can be aligned with the openings 50 in the inwardly facing channel 34 when the top surface 120 of laterally extending head 80 is aligned with the upper end of the inwardly facing channel 34.

Further, as seen in FIG. 4, the lower portion 82 of the first elongated element 60 includes at its lower end 124 an axially directed blind opening 128 which is threaded to receive a suitable threaded fastener 196.

A second elongated element 150 which is somewhat longer than first elongated element 60 is provided. It is generally "D"-shaped in cross-section as seen in FIGS. 2, 5 and 6 and includes outer side walls 146 and 148 which merge into an outer curved rear wall 154.

The second elongated element 150 includes an elongated inwardly facing longitudinally extending recess 160. The recess 160 is generally "D"-shaped and includes inner side walls 166 and 168 that merge into an inner curved rear wall 170.

The inwardly facing longitudinally extending recess 160 is the same size as the first elongated element 60 so that the first and second elongated elements 60 and 150 fit together snugly in close engagement with each other with adjacent side walls 94 and 96 touching inner side walls 164 and 166, and curved rear wall 100 touching inner curved rear wall 170.

The upper portion 174 of second elongated element 150 includes an inwardly facing surface 176. At the lower part of inwardly facing surface 176 is one end of an upwardly facing camming surface 182. The upwardly facing camming surface 182 extends upwardly and inwardly. Its other end ends at the inwardly facing surface 184 on the lower portion 186 of second elongated element 150.

Downwardly and upwardly facing camming surfaces 110 and 182 are complimentary and are adapted to be mutually engagable when the first elongated element 60 is slidably received in the elongated recess 160 in second elongated element 150.

At its lower portion 186 the second elongated element 150 includes an inwardly directed laterally extending tongue 190 which extends inwardly from inwardly facing surface 186. The inwardly directed laterally extending tongue 190 includes a vertically extending opening 194.

The brackets 20 are connected to the chair back 14 by first connecting inwardly facing channel 34 to the lateral edge 28 of the chair back 14. This is initially accomplished by simply placing the inwardly facing channel 34 over the lateral edge 28 in close fitting engagement with its front and rear surfaces, and with the web 44 in close engagement with the lateral edge 28.

The first elongated element 60 is then placed over the inwardly facing channel 34. As seen in FIGS. 2, 5 and 6, the inwardly facing side walls 68 and 70 of the inwardly facing elongated channel shaped recess 64 of the first elongated element 60 will completely enclose the channel legs 38 and 40 and the outwardly facing surface of web 44 is in close engagement with the inwardly facing bottom wall 74 of recess 64 so that the channel 34 is hidden from view.

Suitable threaded fasteners (not shown) are inserted through openings 116 on the first elongated element 60 and openings 50 on the channel 34 to connect them to each other and to the lateral edge 28 of the chair back 14.

The chair back 14 and first elongated elements 60 are now connected to the second elongated elements 150. This is accomplished by "hooking" the downwardly facing camming surface 110 on each first elongated element 60 and the upwardly facing camming surface 174 on each second elongated element 150 so that they are in mutual interlocking engagement and the bottom wall 88 of the first elongated element 60 is in close engagement with the inwardly directed laterally extending tongue 190 on the second elongated element 150.

A threaded fastener 196 is then inserted through the vertically extending opening 194 in the inwardly directed laterally extending tongue 190 and threaded into blind opening 128 in the first elongated element 60.

As the threaded fastener 196 is tightened, it tends to draw the first and second elongated elements 60 and 150 into close engagement along the camming surfaces 110 and 174.

The lower portion 186 of each of the second elements 150 can be connected to the remainder of the chair by any suitable means such as by being connected to the upwardly extending members 24 on the chair. However, such connection does not form a part of this invention, and accordingly, is not illustrated.

It should be understood that when the chair back assembly 10 is assembled the connectors that connect the first elongated element 60 to the inwardly facing channel 34 are hidden from view as is the inwardly facing channel 34 itself. Further the top portions of the inwardly facing channels 34 and the first and second elongated elements are co-planer, either flat or curved. This will help to create the illusion of being one piece after their top surfaces are finished.

Further, the threaded fastener 196 is hidden from view because it is on the underside of the inwardly directed laterally extending tongue 192 and is hidden by the second elongated element 150.

First and second elongated elements 60 and 150 can be made from any suitable material such as a rigid high strength thermoplastic or a metal such as steel, aluminum or the like that can be polished or treated in another manner so as to have a pleasing appearance.

Thus, a pleasing and aesthetically attractive chair back assembly 10 comprising a chair back 14 and brackets 20 has been described where the where the connectors that connect the first and second elongated elements 60 and 150 comprising the brackets to each other, and the connectors connecting the brackets 20 to the chair back 14 are hidden from view.

While the invention has been described with respect to one of its forms, it is apparent that other forms and embodiments will be obvious skilled in the art in view of the foregoing description. Thus, the invention should not be limited by the description, but rather, only by the scope of the appended claims.

I claim:

1. In a chair back assembly of the type comprising a chair back having a lateral edge, first and second elements for connecting said chair back to the remainder of said chair at said lateral edge, the improvement comprising means for connecting said first element to said lateral edge, said second element including an inwardly facing recess, means for connecting said first element to said second element when said first element is in said inwardly facing recess so that said second element overlies said first element and said means for connecting said first element to said lateral edge is covered and is hidden from view by said second element.

2. A chair back assembly as defined in claim 1 wherein said first element has a lower end, and said second element is connected to said first element at said lower end.

3. A chair back assembly as defined in claim 1 wherein said first and second elements are elongated, said second element includes an inwardly directed laterally extending tongue, said inwardly directed and laterally extending tongue lying adjacent to said lower end of said first element, and said means for connecting said first and second elements to each other is operative to connect said inwardly directed laterally extending tongue to said first element at said lower end of said first element where said last named means for connecting is hidden from view.

4. A chair back assembly as defined in claim 1 wherein said first and second elements are elongated, and said means for connecting said first and second elements to each other includes mutually engagable interlocking means for interlocking an upper part of said first and second elements to each other.

5. A chair back assembly as defined in claim 4 including a threaded connector connected between said first and second elements, and said threaded connector is operative to draw said mutually engagable interlocking means into close interlocking engagement.

6. A chair back assembly as defined in claim 1 including an elongated channel for being connected to said lateral edge and for being connected to said first element, said elongated channel including legs and a web, said web lying along said lateral edge and said legs lying along said chair back so that said chair back is supported when said first and second elements are connected to it.

7. A chair back assembly as defined in claim 6 wherein said first element comprises a channel having a web and legs, and said legs of said first element overlie the legs of said channel to hide the legs of said channel from view.

8. A chair back assembly as defined in claim 7 wherein said second element includes an elongated recess, and said first element is received in said elongated recess and is thereby hidden from view.

9. A chair back assembly as defined in claim 1 wherein said means for connecting said second element to said first element in overlying relation to said first element comprises said first element is elongated and includes a downwardly facing and angularly disposed camming surface, said second element is elongated and includes an upwardly and angularly disposed camming surface, said camming surfaces being in mutual interlocking engagement, and means for drawing said camming surfaces into close engagement with each other.

10. A chair back assembly as defined in claim 9 wherein each of said first and second elements includes means for receiving a threaded connector, a threaded connector being disposed in said means for receiving a threaded connector, and said threaded connector is operative to draw said first and second elements into close engagement with each other along said camming surfaces.

11. A chair back assembly as defined in claim 10 wherein said threaded connector is disposed between said second element and said lateral edge so that it is hidden from view.

12. A chair back assembly as defined in claim 9 wherein each of said first and second elements includes laterally spaced side walls, and said camming surface on each of elements is disposed between said laterally spaced sidewalls on its respective element.

13. A chair back assembly as defined in claim 12 wherein said camming surface on said first element slopes upwardly and inwardly, and said camming surface on said second element slopes downwardly and outwardly.

14. In a chair back assembly of the type comprising a chair back having a lateral edge, first and second elements for connecting said chair back to the remainder of said chair at said lateral edge, the improvement comprising means for connecting said first element to said lateral edge, said first element including a lower end, said second element being connected to said first element at said lower end, said second element including an inwardly directed laterally extending tongue, said inwardly directed and laterally extending tongue lying adjacent to said lower end of said first element, means for connecting said second element to said first element with said second element overlying said first element so that said means for connecting said first element to said lateral edge is covered and is hidden from view by said second element, and said means for connecting said first and second elements to each other includes connecting said inwardly directed laterally extending tongue to said first element at said lower end of said first element so that said last named means for connecting said first and second elements is hidden from view.

15. In a chair back assembly of the type comprising a chair back having a lateral edge, first and second elements for connecting said chair back to the remainder of said chair at said lateral edge, the improvement comprising said first and second elements being elongated, means for connecting said first element to said lateral edge, means for connecting said second element to said first element with said second element overlying said first element, said means for connecting said first and second elements to each other includes mutually engagable interlocking means for interlocking an upper part of said first and second elements to each other so that said means for connecting said first element to said lateral edge is covered and is hidden from view by said second element.

16. In a chair back assembly of the type comprising a chair back having a lateral edge, first and second elements for connecting said chair back to the remainder of said chair at said lateral edge, the improvement comprising an elongated channel for being connected to said lateral edge and for being connected to said first element, said elongated channel including legs and a web, said web lying along said lateral edge and said legs lying along said chair back so that said chair back is supported when said first and second elements are connected to it, means for connecting said first element to said lateral edge and in overlying relation to said elongated channel, means for connecting said second element to said first element with said second element overlying said first element so that said means for connecting said first element to said lateral edge is covered and is hidden from view by said second element, means for hiding from view said means for connecting said second element to said first element and to said lateral edge.

17. In a chair back assembly of the type comprising a chair back having a lateral edge, first and second elements for connecting said chair back to the remainder of said chair at said lateral edge, the improvement comprising means for connecting said first element to said lateral edge, means for connecting said second element to said first element with said second element overlying said first element so that said means for connecting said first element to said lateral edge is covered and is hidden from view by said second element, said means for connecting said second element to said first element in overlying relation to said first element comprises said first element is being elongated and including a downwardly facing and angularly disposed camming surface, said means for connecting said second element to said first element in overlying relation to said first element further comprising said second element being elongated and including an upwardly and angularly disposed camming surface, said camming surfaces being in mutual interlocking engagement, and means for drawing said camming surfaces into close engagement with each other so that said means for connecting said second element to said first element and to said lateral edge are hidden from view.

* * * * *